US005198841A

United States Patent [19]

Sakamoto

[11] Patent Number: 5,198,841

[45] Date of Patent: Mar. 30, 1993

[54] ELECTRIC PRINTER

[75] Inventor: Masashi Sakamoto, Toyohashi, Japan

[73] Assignee: Minolta Camera Kabushiki Kaisha, Osaka, Japan

[21] Appl. No.: 624,329

[22] Filed: Dec. 7, 1990

[30] Foreign Application Priority Data

Dec. 8, 1989 [JP] Japan ..... 1-320348

[51] Int. Cl.[5] ..... G03G 15/01

[52] U.S. Cl. ..... 346/157; 355/326; 355/328

[58] Field of Search ..... 346/157; 355/326, 328

[56] References Cited

U.S. PATENT DOCUMENTS 4,591,903 5/1986 Kawamura et al. ..... 358/75
4,664,501 5/1987 Koizumi et al. ..... 355/4
4,952,983 8/1990 Ito et al. ..... 355/328
4,982,242 1/1991 Ishii et al. ..... 355/326
5,021,838 6/1991 Parker et al. ..... 355/328

*Primary Examiner*—George H. Miller, Jr.
*Attorney, Agent, or Firm*—Willian Brinks Olds Hofer Gilson & Lione

[57] ABSTRACT

An electric printer is capable of printing images on a large size sheet. The electric printer is provided with a print head to output images on a photoconductive member based on image data and a plurality of process units each of which integrally accommodates therein at least a photoconductive member, a developing device and a cleaner for forming the images on the sheet transported along a transport path within the printer. The process units are disposed in a direction orthogonally intersecting a transport direction of the sheets so as to form the images thereby on the sheet as it is being transported.

12 Claims, 13 Drawing Sheets

ELECTRIC PRINTER

BACKGROUND OF THE INVENTION

1. Field of the Invention

The present invention relates to an electric printer using a processing unit for electrophotographic printing.

2. Description of the Prior Art

Recently, compact printers connected to personal computers and the like have begun using process units wherein a photoconductive drum, developing device and cleaner are contained in a single integrated unit. Use of the aforesaid type of process unit is extremely logical from the perspective of device maintenance inasmuch as the photoconductive drum, developing device and cleaner can be maintained by simply replacing the used unit with a new unit when, for example, the toner accommodated in the developing device is depleted. A problem of high device maintenance costs arise when the aforesaid type of disposable process unit is used, but this disadvantage is mitigated by the reduction in the cost of the unit produced by automated assembly and mass production of said process units.

On the other hand, JIS standards for large electrophotographic printers capable of printing A0 and Al sizes are limited to use in computer aided design (CAD) illustrations and the like. Thus, it is difficult to mass produce the aforesaid process units and achieve the resulting cost reduction, and rationalization of the use of said process units has yet to be realized.

SUMMARY OF THE INVENTION

A main object of the present invention is to provide an easy-to-maintain electric printer capable of forming images on paper of various sizes.

A further object of the present invention is to provide a large size yet low cost electric printer capable of forming images on large size paper.

A still further object of the present invention is to provide a large size electric printer capable of using a process unit which accommodates a photoconductive drum, developing unit, cleaner and the like in a single integrated unit.

The aforesaid objects of the present invention are accomplished by providing an electric printer comprising:

a print head to output images based on image data and a plurality of process units each of which integrally accommodates therein at least a photoconductive member, a developing device and a cleaner for forming the images output by said print head on a recording media transported along a transport path within the printer, said process units being disposed in a direction orthogonally intersecting a transport direction of the recording media so as to form the images thereby on the recording media as it is being transported.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
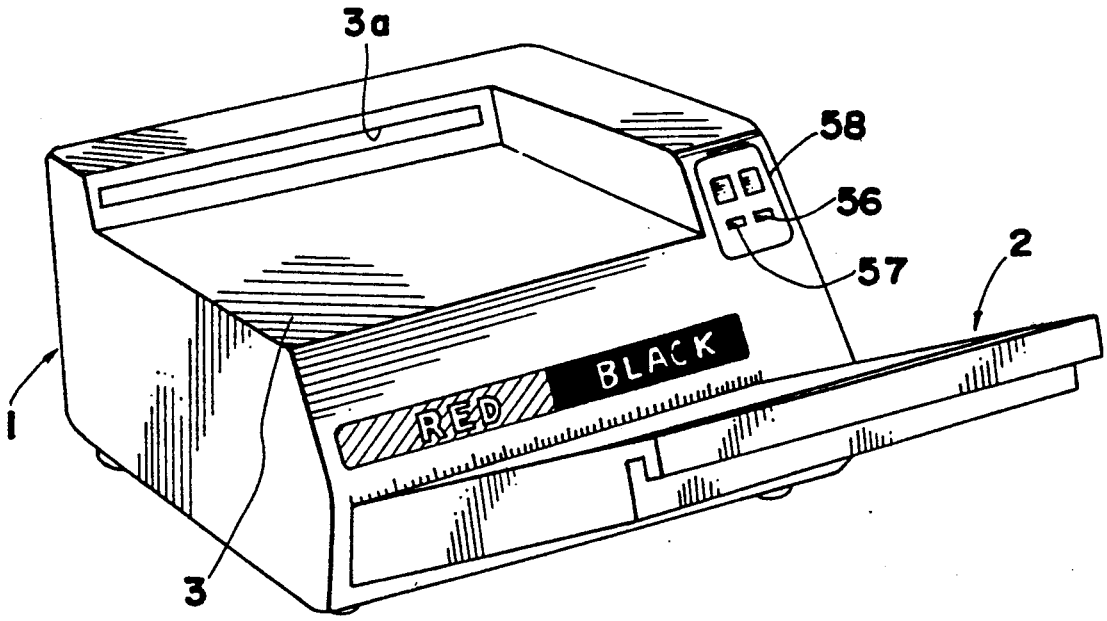
FIG. 1 is an exterior perspective view of a first embodiment of the electric printer of the present invention.
Figure 2:
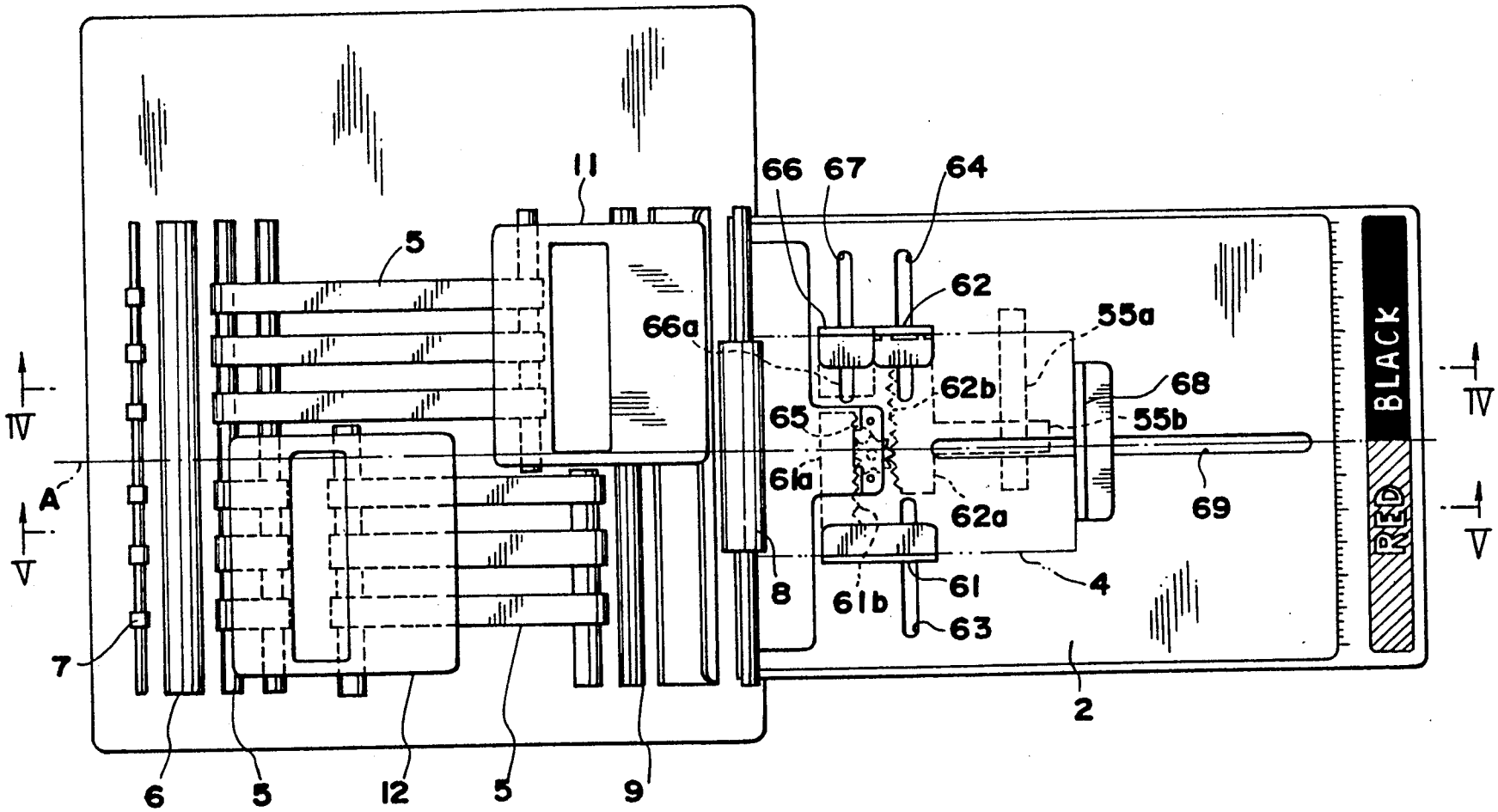
FIG. 2 is a brief block diagram showing the paper supply unit and process unit.
Figure 3:
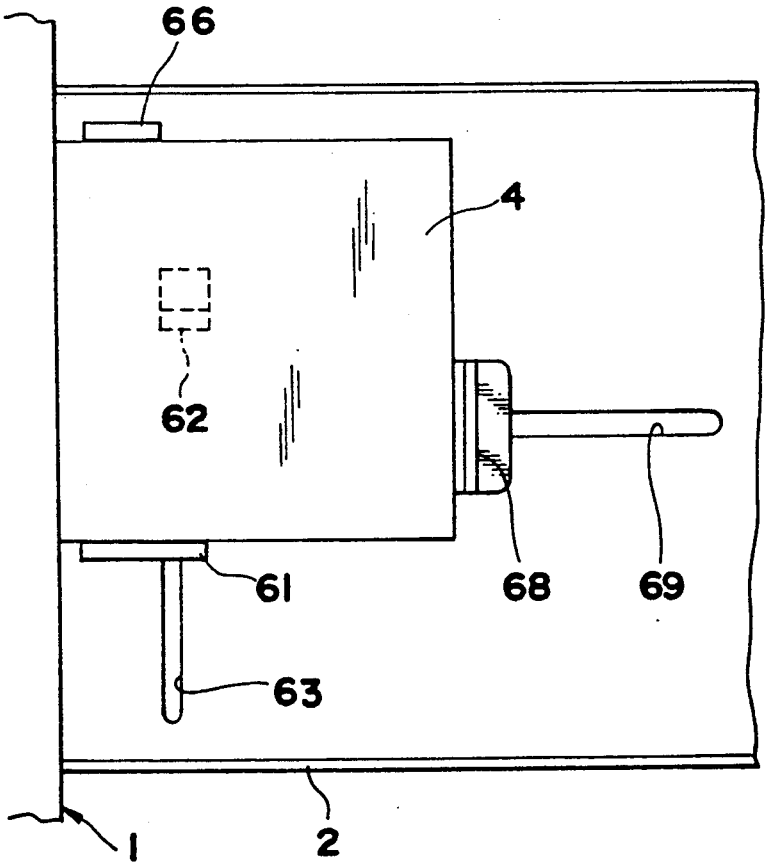
FIG. 3 is an illustration of a sheet being fed to the printer when said sheet is inclined to one side of the paper supply cassette.
Figure 4:
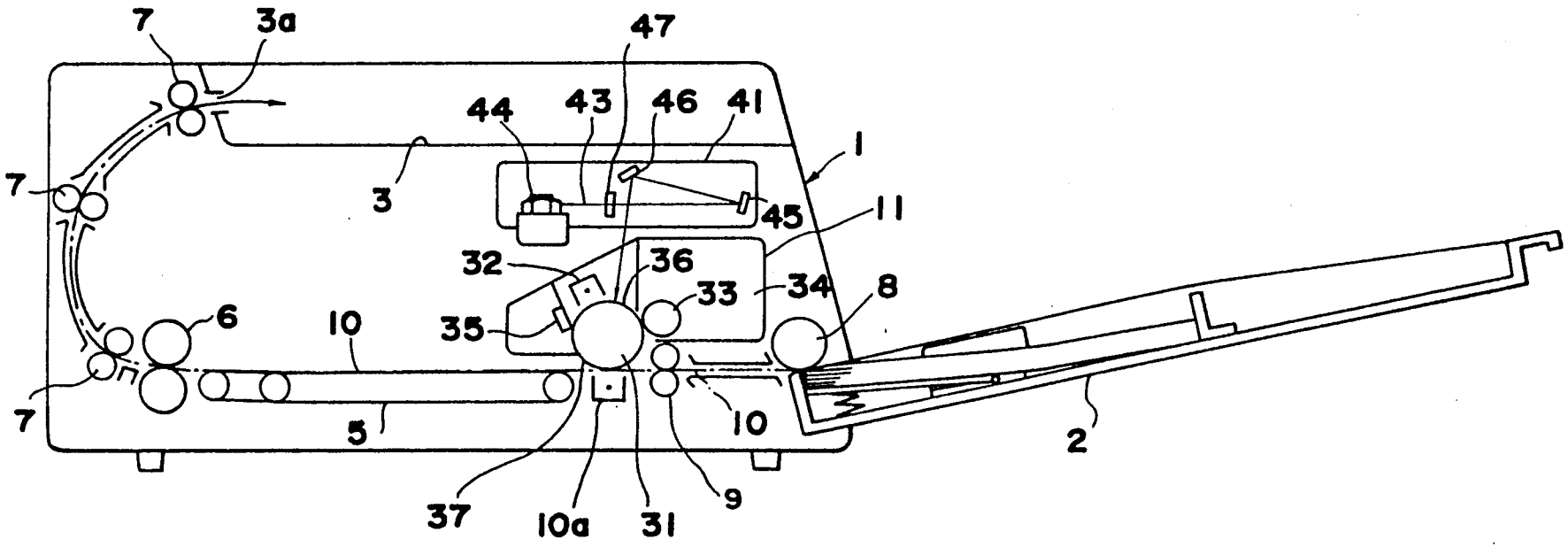
FIG. 4 is a section view on the IV—IV line shown in FIG. 2.

FIGS. 1 through 11 show a first embodiment wherein the present invention is applied to a laser printer. As shown in FIG. 1, a paper supply cassette 2 is provided at one end of printer 1, and a sheet discharge tray 3 is formed on the top surface of said printer 1. As shown in FIG. 4, printer 1 has sequentially disposed therein a takeup roller 8 for transporting recording sheet 4 accommodated in paper supply cassette 2 and transporting said sheet 4 to paper path 10, a pair of timing rollers 9 which stop one edge of said transported recording sheet 4 at the nip between said rollers 9 so as to adjust the leading edge of said sheet 4 to prevent sheet drifting as well as to transport recording sheet 4 to the printing portion with a specified transport timing, a transport belt 5, a pair of fixing rollers 6 for executing a fixing process on recording sheet 4 after printing, and a plurality of discharge rollers 7 for discharging recording sheet 4 after printing to a discharge tray 3. First and second process units 11 and 12 are arranged above transport belt 5 in FIG. 5 in a direction orthogonally intersecting the paper transport direction of said transport belt 5 as indicated by the arrow.

More specifically, the second process unit 12 is disposed in the paper transport direction on the downstream side of first process unit 11. The aforesaid arrangement of first process unit 11 and second process unit 12 provides that the printing range of first process unit 11 and the printing range of second process unit 12 are continuous in a direction orthogonally intersecting the paper transport direction, such that the image printed by first process unit 11 and the image printed by the second process unit 12 are uninterrupted. The first process unit 11 and second process unit 12 arranged in the manner previously described form images with different timing relative to the transported recording sheet 4.

Figure 5:
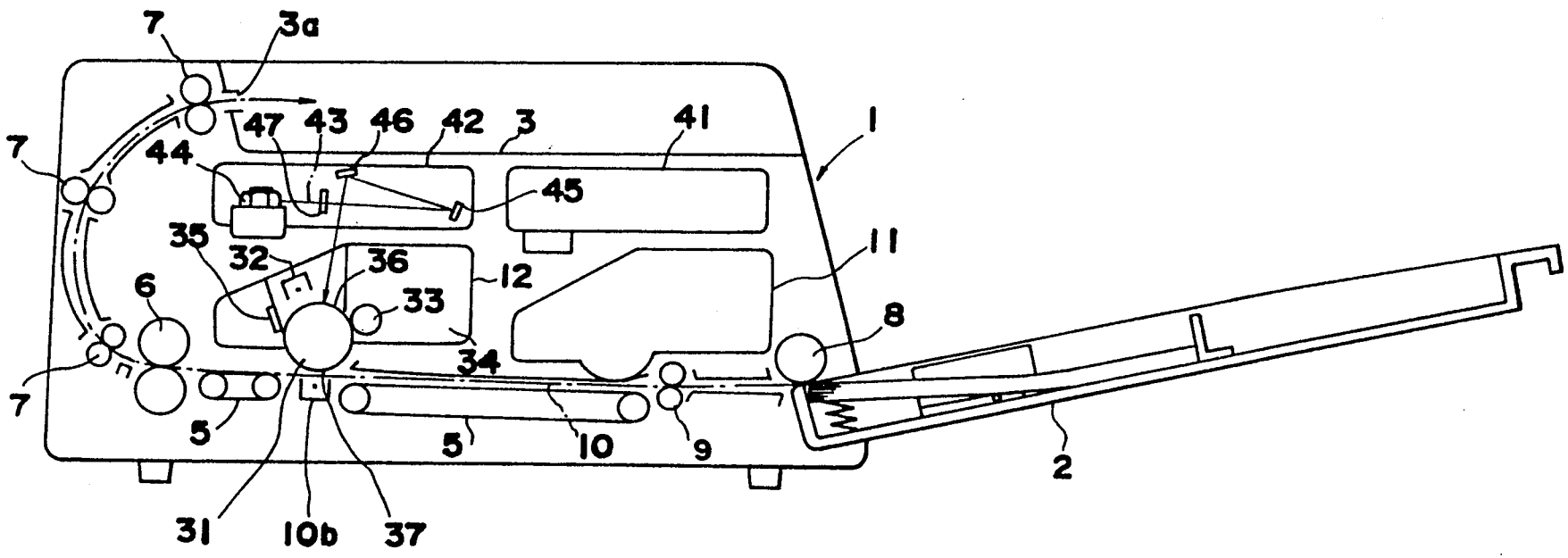
FIG. 5 is a section view on the V—V line shown in FIG. 2.

First and second process units 11 and 12 have identical constructions which provide a charger 32, developing roller 33, toner hopper 34 and cleaner 35 which are disposed around a photoconductive drum 31, as shown in FIGS. 4 and 5. An exposure portion 36 is provided between charger 32 and developing roller 33, and a transfer portion 37 is disposed between developing roller 33 and cleaner 35.

Print heads 41 and 42 for accomplishing image exposure on the exposure portion 36 of photoconductive drum 31 are provided above process units 11 and 12, respectively. As shown in FIGS. 4 and 5, in print heads 41 and 42, laser beams 43 from laser light sources not shown in the drawings are modulated in accordance with image signals and deflected in the main scan direction by scanners 44 comprising polygonal mirrors or the like. Deflected laser light 43 is subjected to correction by fϕ lens 47, then directed to the exposure portion 36 on the photoconductive drum 31 by means of mirrors 45 and 46. Subsequently, the laser light 43 scans in the axial direction the surface of photoconductive drum 31 so as to expose an image thereon. At that time, electrostatic latent image is formed on the surface of photoconductive drum 31 in accordance with image signals by means of the aforesaid image exposure because the rotating surface of photoconductive drum 31 travels in the sub scanning direction. The aforesaid electrostatic latent image is developed by developing roller 33 so as to be rendered visible. At transfer portion 37, transfer chargers 10*a* and 10*b* are disposed opposite photoconductive drum 31 through the paper transport path formed at the bottom of said photoconductive drum 31. The developed image on the surface of photoconductive drum 31 is transferred by means of transfer chargers 10*a* and 10*b* onto the surface of recording sheet 4 being transported through the paper transport path.

Figure 6:
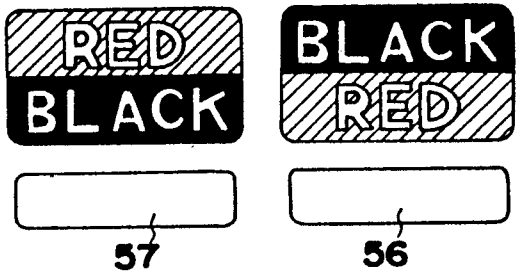
FIG. 6 is an elevation view of the main switch system of the operation panel.

The present embodiment of the printer is capable of printing paper sizes up to A2 (594×420 mm), so that each process unit 11 and 12 uses A4 size sheets (297×210 mm) which are ½ the size of A2 sheets. Accordingly, print heads 41 and 42 also use A4 size sheets corresponding to the width (210 mm) of process units 11 and 12. printing It is difficult, however, to align the borders of the images printed by process units 11 and 12 by simply adjusting the mounting positions of the respective print heads 41 and 42. Thus, the setting position of at least one of the print heads 41 and 42 can be adjusted in both the main scan direction and sub scan direction by means of the print controller 52 in control circuit 51, as shown in FIG. 6.

In the present embodiment, first process unit 11 is positioned in closer proximity to timing roller 9 than is second process unit 12, as shown in FIG. 2, to facilitate the timing when recording sheet 4 is transported toward the transfer portion. When printing a sheet smaller than A4 size, supplying said sheet to the first process unit 11 and using only the corresponding print head 41 is desirable. In the aforesaid situation the second process unit 12 is operated only when necessary to prevent unnecessary wear of the surface of photoconductive drum 31 by cleaner 35 within said second process unit 12, and thereby prevent shortening of the service life of said photoconductive drum.

Paper supply cassette 2 is described in detail hereinafter with reference to FIG. 2. A pair of right and left sheet guides 61 and 62 are provided so as to travel along guide channels 63 and 64 in the width direction relative to center sheet reference A. Sheet guide 61 on one side is fixedly mounted so as to be perpendicular to movable plate 61*a*. The other sheet guide 62 is mounted so as to be rotatable between a state perpendicular relative to movable plate 62*a* and a state unaligned therewith. Racks 61*b* and 62*b* are formed on movable plates 61*a* and 62*a*, respectively. Movable plate 61*a* moves in synchronism with movable plate 62*a* by means of pinion 65 which is engaged with both of racks 61*b* and 62*b*. Sheet guides 61 and 62 travel so as to normally maintain equidistance relative to sheet reference A, and when both sheet guides 61 and 62 are in perpendicular states, the various sizes of recording sheet 4 can be positioned so that the center of said sheet 4 aligns with the aforesaid sheet reference A.

However, sheet guide 62 is capable of being released from restricting the position of sheet 4 by being lowered. In such a case, the other sheet guide 16 along determines the position of recording sheet 4. As shown in FIG. 3, a secondary sheet guide 66 is provided opposite sheet guide 61 so as to be independently movable, such that the center of recording sheet 5 can be positioned away from the aforesaid sheet reference a by means of secondary sheet guide 66 and sheet guide 61. Item 66*a* is a movable plate provided on secondary sheet guide 66, item 67 is a guide channel, item 68 is a sheet trailing edge guide for positioning the trailing edge of the sheet in the sheet transport direction, and item 69 is a guide channel provided to make sheet trailing edge guide 68 movable in he sheet transport direction.

The paper supply positions an be set so as to use only the previously described first process unit 11 and print head 41 because paper supply cassette 2 allows the supply position of recording sheet 4 to be freely shifted. Thus, the print area proportions can be changed for each process unit 11 and 12 relative to recording sheet 4 by optional selection of the aforesaid paper supply position.

Figure 7:
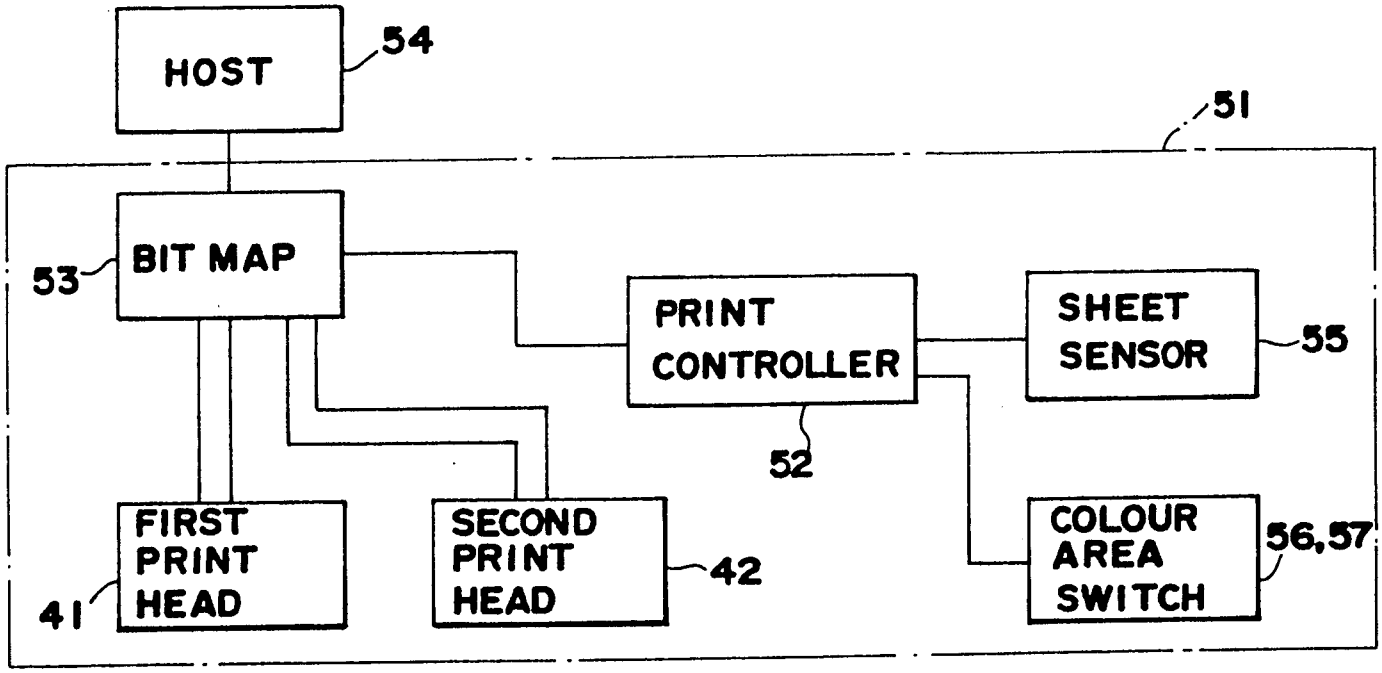
FIG. 7 is a control circuit diagram.
Figure 8:
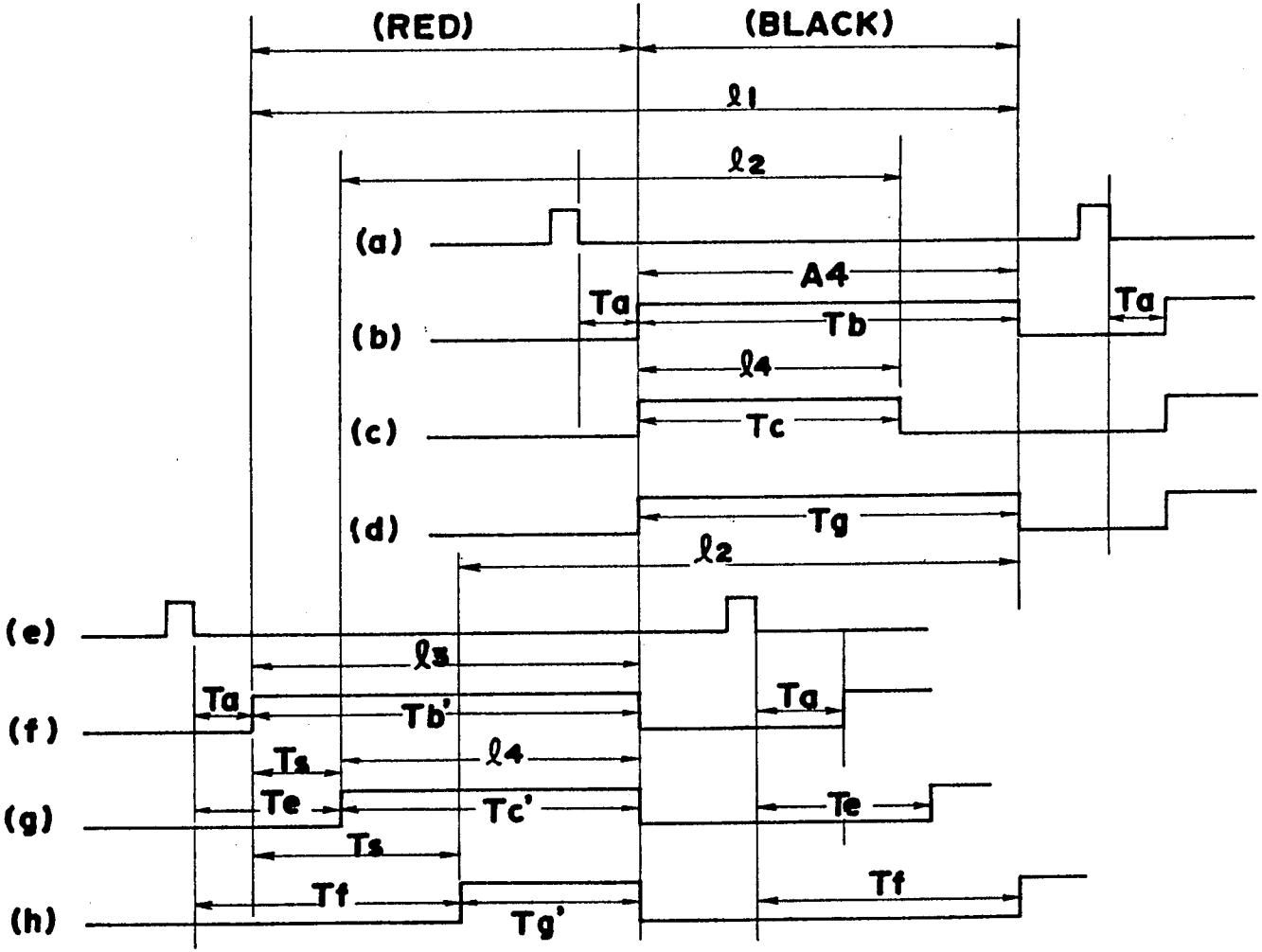
FIG. 8 is a flow chart showing the image writing process performed by the first and second print heads.

Control circuit 52 provides a bit map 53, as shown in FIG. 7, that receives monochrome image data from host computer 54 and stores in memory said complete image plane dot data as image data. Bit map 53 apportions the aforesaid stored image data to print heads 41 and 442 in accordance with the print information received from print controller 52, and prints said data as a single image by means of process units 11 and 12 corresponding of the aforesaid respective print heads 41 and 42. First process unit 11 prints black and second process unit 12 prints red, as shown in FIGS. 1 and 2. Each of the process units 11 and 12 is capable of printing the same color or various other different colors by replacing the print color with a suitable alternative color.

Print controller 52 controls bit map 53 in accordance with signals from sheet sensor 55 which detects the trailing edge of recording sheet 4 in the perpendicular direction relative to the sheet transport direction, and signals from color area switches 56 and 57. Sheet sensor 55 comprises a variable resistor 55*a* and oscillator 55*b* that oscillates resistor 55*a*; oscillator 55*b* is fixedly mounted to movable plate 62*a*. The resistance value of the aforesaid variable resistance is changed by the movement of oscillator 55*b* in conjunction with the movement of movable plate 62*a*, and the position of sheet guide 6 2 is detectable by the aforesaid change in resistance value. Sheet guides 61 and 62 are disposed so as to normally maintain equidistance relative to sheet reference A, and, therefore, the position of sheet guide 61 is detectable from the position of sheet guide 62. Further, the trailing portion of recording sheet 4 on paper supply cassette 2 is detectable from the position of sheet guide 61.

As shown in FIG. 1, color area switches 56 and 57 are provided on scan panel 58 for switching the image data output stored in bit map 53 from executing from the top of executing from the rear. A black/red display corresponding to color area switch 56 had a red/black display corresponding to color area switch 57 are provided on scan panel 58.

The print timing of print heads 41 and 42 corresponding to print areas $E_1$ and $E_2$ of the respective process units 11 and 12 is hereinafter described. The time corresponding to print width of the image stored in bit map 53 is designated $T_B$, the set time corresponding to print area $E_1$ of first process unit 11 (set at 210 mm so as to correspond to the short side of an A4 size sheet, to wit, 210 mm) is designated $t_1$, and the set time corresponding to print area $E_2$ of second process unit 12 (set at the same value as $e_1$, to wit, 210 mm) is designated $T_2$. The time corresponding to the distance form the starting position $S_2$ of second process unit 12 print area $E_2$ to the edge portion of recording sheet 4 detected by the sheet sensor is designated $t_S$. That is, the time $T_B$ is determined by the image data input from the host computer, and the time $T_S$ is determined by the output from the sheet sensor that detects the edge position of the recording sheet. The main scan timing set by a scan start signal SOS generated when laser light 43 is detected at other than the specified position of the main scan region by means of a sensor not shown in the drawings. The timing by which signal SOS is generated is shown in FIGS. 8*a* and 8*e*. The set time corresponding to start position $S_1$ of print area $E_1$ from signal SOS, as well as that corresponding to the start position $S_2$ of print area $E_2$ from signal SOS is designated time $T_a$.

Figure 9:
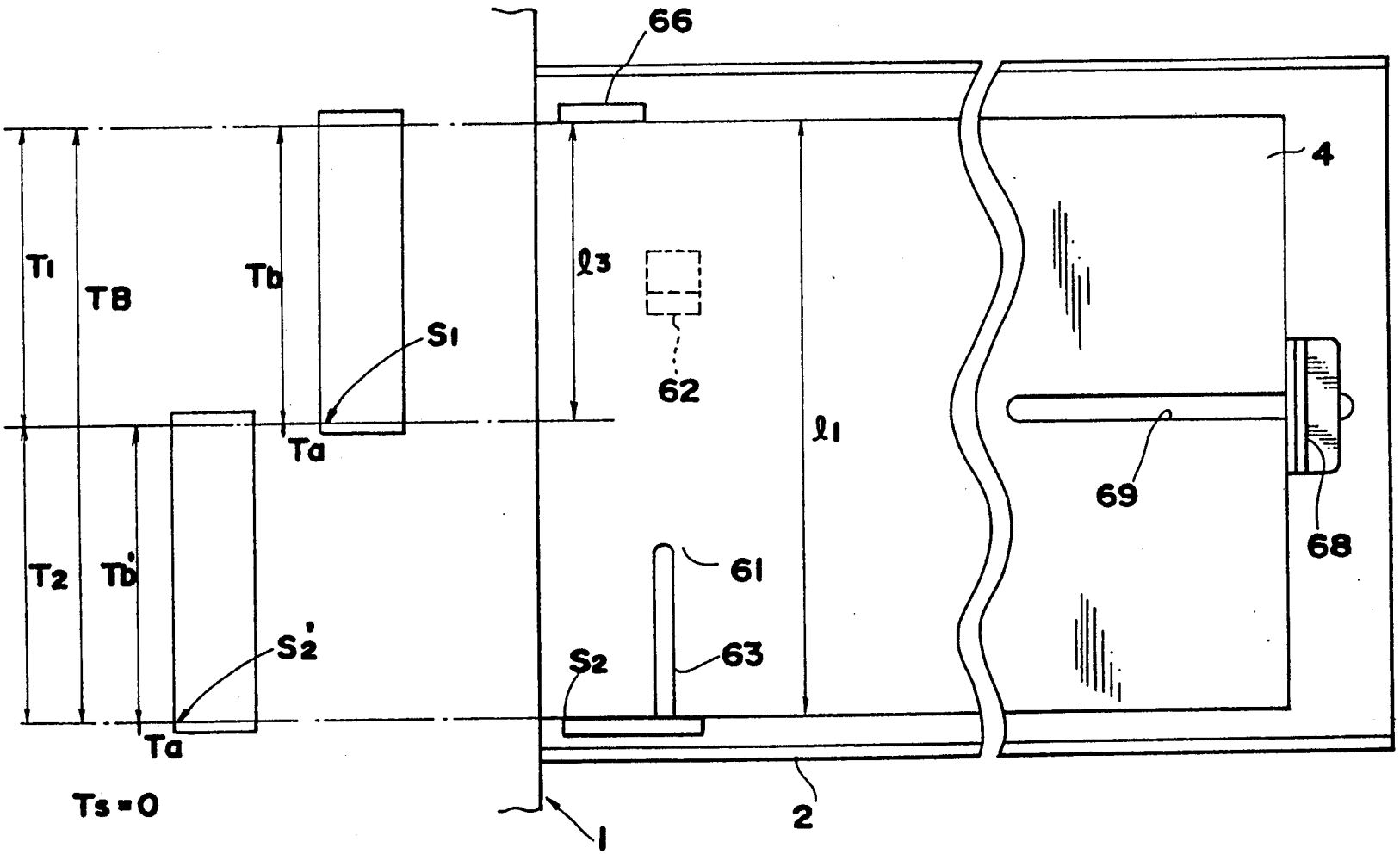
FIG. 9 is an illustration of an A2 size sheet being printed.

As shown in FIG. 9, when the center of a large A2 size image is aligned with sheet reference A and transported with said alignment for printing, image writing starts by first print head 41 after a set time $T_a$ from the generation of signal SOS, and image writing is completed at a time $T_b$ after the start of image writing.

Image writing by second print head 42 starts after a specified delay time T elapses from the start of image writing by first print head 41. The aforesaid delay time T delays the printing of recording sheet 4 by positioning second print head 42 behind first print head 41 in the sheet transport direction, and therefore said delay must be considered. In printing an A2 size sheet, image writing starts after a set time $T_a$ from the generation of the previously described signal SOS, and image writing is completed after a time $T_b$, from the start of said image writing. The start of image writing by second print head 42 and the completion of image writing by first print head 41 is described hereinafter. Image writing by second print head 42 starts after time $T_s$ elapses following the passage of a set time $T_a$. When printing an A2 size sheet, the edge portion of the sheet from the sheet size 61 position aligns with the start position $S_2$ of print area $E_2$, as shown in FIG. 9, such that $T_s$ becomes zero [0]. Accordingly, image writing by second print head 42 starts after a specified time $T_a$ elapses from the generation of signal SOS. On the other hand, image writing by first print head 41 is accomplished after a time $T_b$ following the specified time $T_a$, said time $T_b$ being obtained by the calculations described below. First, time $T_b'$ is determined from the expression $T_b'=T_2-T_s$. Since, $T_s=0$, therefore, $T_b'=T_2$. Then, time $T_b'$ can be determined by the expression $T_b=T_B-T_b'$.

Figure 12:
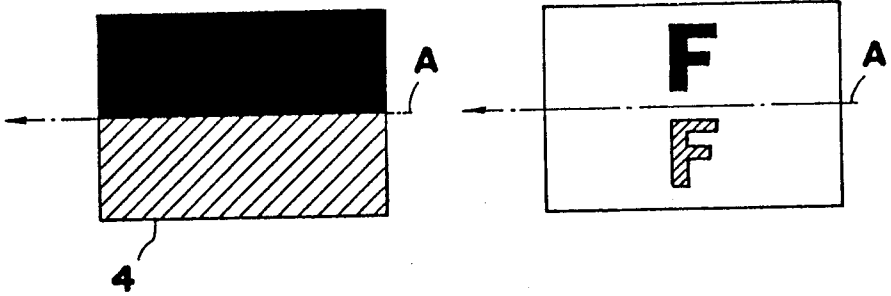
FIGS. 12 through 15 are top views showing each state of a printed image.
Figure 13:
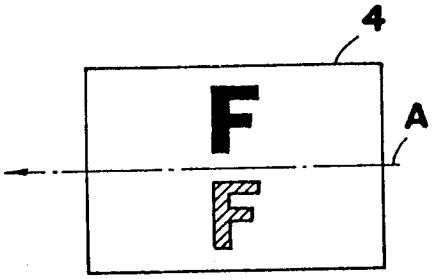
Figure 14:
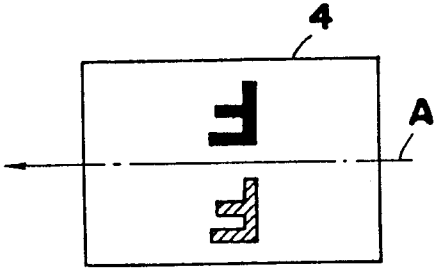
Figure 15:
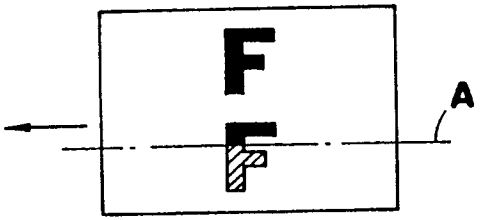

An image can be printed on the entire A2 size recording sheet 4 by first and second print heads 41 and 42 and first and second process units 11 and 12. The print image at this time is black on the right side of sheet reference A and red on the left side of sheet reference A in the paper transport direction as indicated by the arrow in FIG. 12, such that the border lines are aligned at the center of recording sheet 4. When color area key 56 corresponding to the black/red display is depressed, printing is executed by print heads 41 and 42 with the image data stored in bit map 53 being output from the top of said data, and the top of the image is printed black in an erect image state, as shown in FIG. 12. When red/black color area key 57 is depressed, printing is executed by print heads 41 and 42 with the image data stored in bit map 53 being output from the back of said data, and the top of the image is printed black in an inverted image state, as shown in FIG. 14.

Figure 10:
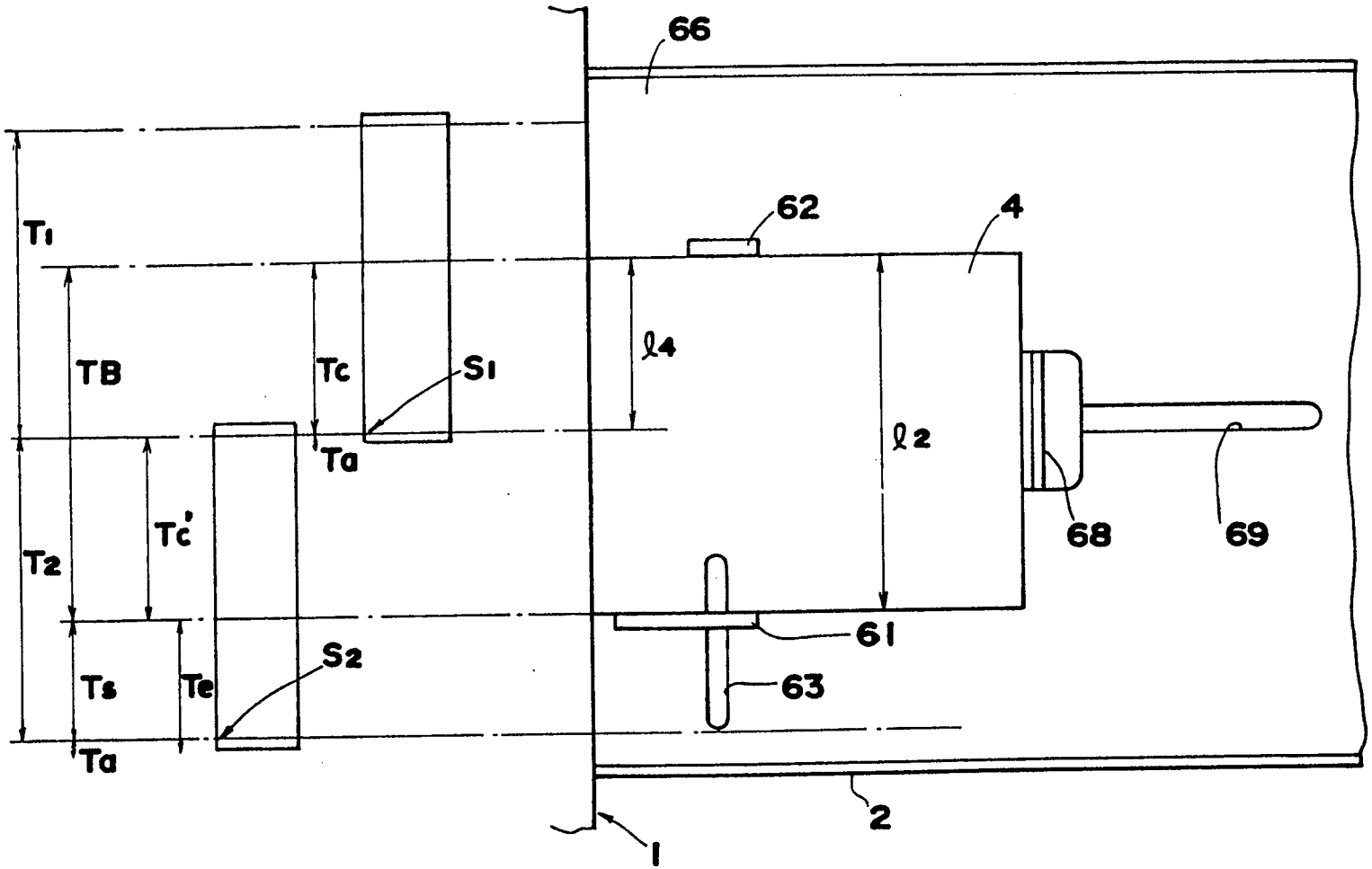
FIG. 10 is an illustration of an A3 size sheet being printed wherein the sheet center is aligned with sheet reference A.

Printing on A3 size paper is described hereinafter, as shown in FIG. 10. Image writing by first print head 41 starts after the aforesaid specified time $T_a$ elapses from the generation of signal SOS, and image writing is completed after a time $T_c$ elapses from the start of said image writing.

After a specified time T elapses from the start of the main scan by first print head 41, image writing by second print head 42 starts after a time $T_e$ elapses from the generation of signal SOS, and image writing is completed after a time $T_c'$ elapses from the start of said image writing.

As shown in FIG. 10, image writing by second print head 42 starts after a time $T_e$ elapses, to wit, after a time period wherein time $T_s$ is added to time $T_a$. Further, image writing by first print head 41 is completed after a time $T_c$ elapses following the passage of a specified time $T_a$; the time $T_c$ is determined in the manner described below. Time $T_c'$ is determined from the expression $T_c'=T_2-T_s$. Then, time $T_c$ can be determined by the expression $T_c=T_B-t_c'$.

The result of the previously described process is that a two-color image can be printed which is divided at the center position of transported A3 size recording sheet 4.

A description follows hereinafter of printing an A3 size recording sheet 4 with the center of said sheet being offset from the sheet reference A.

Image writing by first print head 41 starts after a specified time $T_a$ elapses from the generation of signal SOS, and image writing is completed after a time $T_g$ elapses from the start of image writing. On the other hand, image writing by second print head 42 starts after a time $T_f$ elapses from the generation of signal SOS, and image writing is completed after a time $T_f'$ elapses from the start of said image writing.

Figure 11:
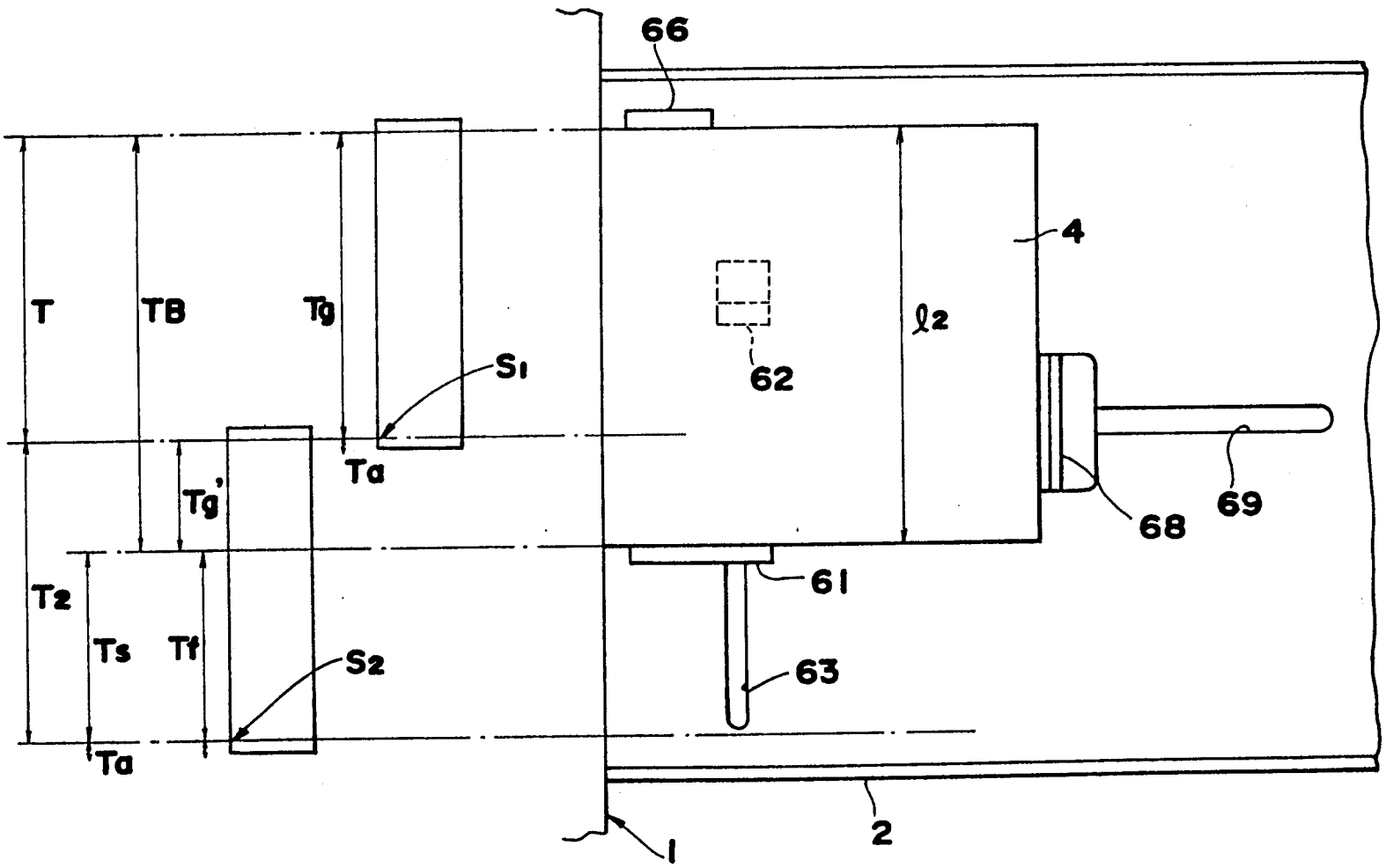
FIG. 11 is an illustration of an A3 size sheet being printed wherein the sheet center is inclined toward one side.

As shown in FIG. 11, image writing by second print head 42 starts after a specified time $T_f$ elapses, to wit, after a time period Where in time $T_s$ is added to specified time $T_a$. Further, image writing by first print head 41 is completed after a time $T_g$ elapses following the passage of a specified time T ; the time $T_g$ is determined in the manner described below. Time $T_g'$ is determined from the expression $T_g'=T_2-T_s$. Then, time $T_g$ can be determined by the expression $T_g=T_B-t_g'$.

The result of the previously described process is that an image can be printed which conforms to the size of recording sheet 4 in the shifted transport position, and the print allocation proportions can be set for first print head 41 and first process unit 11, and second print head 42 and second process unit 12 such that the center of recording sheet 4 is at a position other than sheet reference A.

Printing by each print head 41 and 42 may be set so as to be switched 90 degrees in addition to 180 degrees. When said print heads 41 and 42 are switched 90 degrees, the divisional direction of regions of the image to be printed in different colors on recording sheet 4 can be switched 90 degrees.

Figure 16:
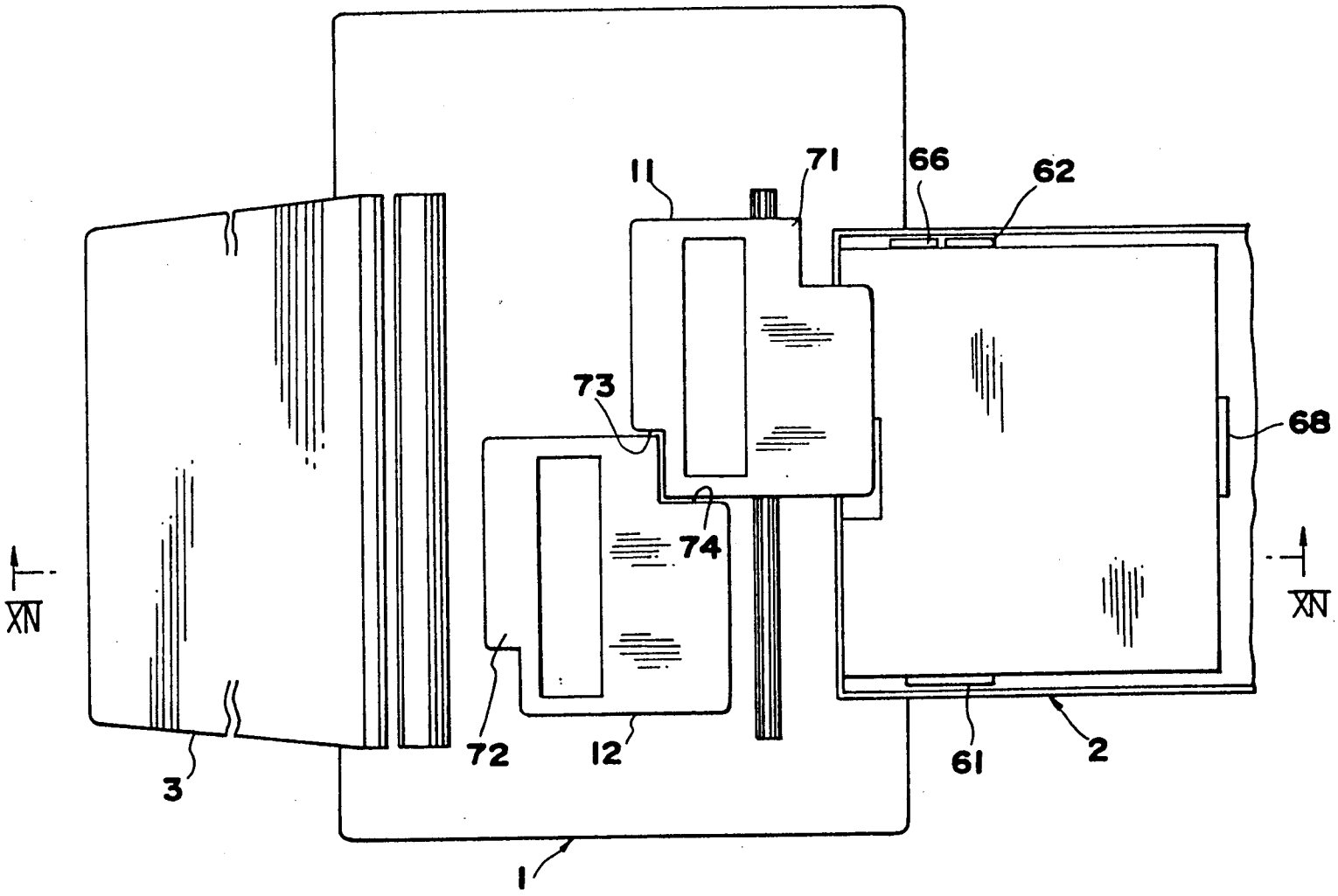
FIG. 16 is a brief block diagram of the paper supply cassette and process unit of a second embodiment of the printer.
Figure 17:
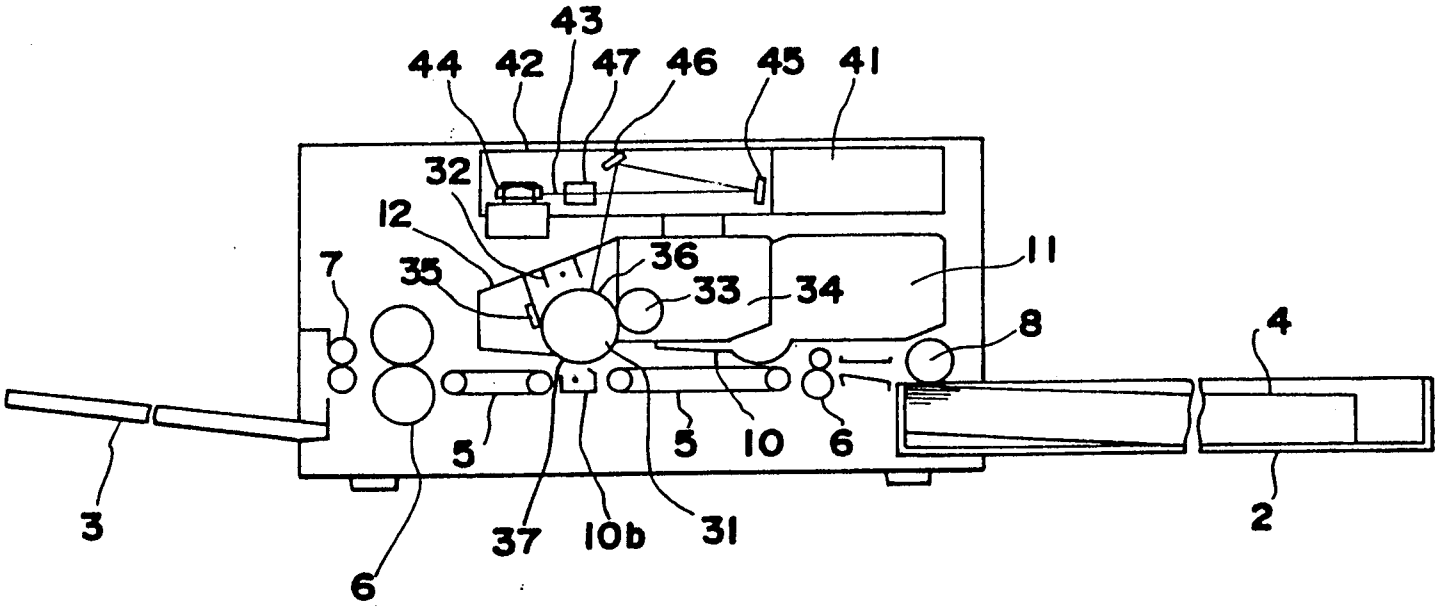
FIG. 17 is a section view on the XIV—XIV line of the embodiment shown in FIG. 16.

FIGS. 16 and 17 show a second embodiment of the present invention wherein the mutually opposing portions of the housing 71 of process unit 11 and the housing 72 of process unit 12 have engaging recessed portions 73 and 74 formed therein, such that parts of housings 71 and 72 overlap in both the sheet transport direction and sheet width direction by means of the aforesaid engagement. Each recessed portion 73 and 74 form both housings 73 and 74 such that the shape of each conforms to the shape of the other so as to comprise a common body of a single type and thereby allow cost reduction through mass production.

Gaps between the process units can be slight and the dimensions of the entire printer in the sheet transport direction can be minimized to eliminate the space at the borderline of the printing regions of both process unit 11 and process unit 12 by means of the previously described engagement. Further, in the sheet width direction the printing regions are small and overlap, and the borderline of the print image in each printing region is readily adjustable by adjusting the printing position of print heads 41 and 42.

Although the aforesaid embodiment has been described as having two process units 11 and 12, the present invention is not limited to such an arrangement and may use engagements of more than two.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. An electric printer comprising:

a print head to output images based on image data; and a plurality of process units each of which integrally accommodates therein at least a photoconductive member, a developing device and a cleaner for forming the images output by said print head on a recording media transported along a transport path within the printer, said plurality of process units being disposed at different positions relative to one another along a direction orthogonally intersecting a transport direction of the recording media so as to form the images thereby on the recording media as it si being transported.

2. An electric printer as claimed in claim 1 wherein said plurality of process units is additionally disposed at different positions relative to one another along the transport direction of the recording media.

3. An electric printer as claimed in claim 1 wherein each of the developing devices accommodated in the process units contains a developer to develop the image formed on the photoconductive member, the developers contained in the developing devices being different in color from each other.

4. An electric printer as claimed in claim 1 wherein the print head is capable of changing an outputting direction upon outputting the images on the photoconductive member.

5. An eccentric printer as claimed in claim 1 further comprising:

supply means having a stacking plate for stacking the recording media thereon and a pair of regulating members for regulating a width of the recording media, at least one of said regulating members being movable on the stacking plate.

6. An electric printer as claimed in claim 1 further comprising:

detecting means or detecting the recording media supplying position according to the position of the regulating members.

7. An electric printer comprising;

first forming means for forming images on a photoconductive member based on image data; and second forming means including a first unit and a second unit each of which forms the images on a recording media and which is disposed at different positions relative to one another along a direction orthogonal intersecting a transport direction of the recording media transported along a transport path within the printer, said first unit being positioned upstream of said second unit with respect to the transport direction of the recording media, whereby on the recording media the images from both said first and second units are formed.

8. An electric printer as claimed in claim 7 wherein each of the first and second units integrally accommodates therein at least the photoconductive member, a developing device and a cleaner.

9. An electric printer as claimed in claim 8 wherein each of the developing devices accommodated in the units contains a developer to develop the image formed on the photoconductive member, the developers contained in the developing devices being different in color from each other.

10. An image forming method by use of an electric printer comprising the steps of:

forming images on a photoconductive member based on image data;

providing at different positions relative to one another along a direction orthogonally intersecting a transport direction of a recording media transported along a transport path within the printer a plurality of image forming units each of which integrally accommodates therein at least the photoconductive member, a developing device and a cleaner; and forming the images on the recording media by means of said image forming units.

11. An image forming method as claimed in claim 10 further comprising the step of:

additionally positioning said plurality of image forming units at different positions relative to one another along the transport direction of the recording media.

12. In an electric printer which forms an image on a recording media as it is transported, the printer comprising:

first image forming means disposed on a path of the recording media and extending to form a first image on the recording media, said first image covering a certain portion laterally with respect to a transporting direction of the recording media; and second image forming means disposed on said path of the recording media at a position different from the first image forming means to form a second image on the recording media, said second image covering the remaining portion such that a composite of the first and second images is formed on the recording media.

* * * * *

UNITED STATES PATENT AND TRADEMARK OFFICE

CERTIFICATE OF CORRECTION

PATENT NO. : 5,198,841

DATED : March 30, 1993

INVENTOR(S) : Masashi Sakamoto

It is certified that error appears in the above-identified patent and that said Letters Patent is hereby corrected as shown below:

In col. 3, line 44, before "width" insert --printing--.

In col. 3, line 45, delete "printing".

In col. 4, line 20, change "16" to --61--.

In col. 4, line 25, change "a" to --A--.

In col. 4, line 32, change "he" to --the--.

In col. 4, line 34, change "an" to --can--.

In col. 4, line 42, change "52" to --51--.

In col. 4, line 47, change "442" to --42--.

In col. 4, line 50, change "of" to --to--.

In col. 5, line 10, change "of" to --or--.

In col. 5, line 23, change "$e_1$" to --$E_1$--.

In col. 5, line 27, change "$t_s$" to --$T_s$--.

In col. 6, line 56, change "$T_f'$" to --$T_g'$--.

In col. 6, line 60, change "Where in" to --wherein--.

UNITED STATES PATENT AND TRADEMARK OFFICE

CERTIFICATE OF CORRECTION

PATENT NO. : 5,198,841

DATED : March 30, 1993

INVENTOR(S) : Masahi Sakamoto

It is certified that error appears in the above-identified patent and that said Letters Patent is hereby corrected as shown below:

In col. 6, line 63, change "T" to --$T_s$--.

In col. 7, line 61, (claim 1, line 14), change "si" to --is--.

In col. 8, line 8 (claim 5, line 1), change "eccentric" to --electric--.

In col. 8, line 27 (claim 7, line 8), change "orthogonal" to --orthogonally--.

Signed and Sealed this

Seventh Day of December, 1993

*Attest:*

*Attesting Officer*

BRUCE LEHMAN

*Commissioner of Patents and Trademarks*